US007982567B2

(12) United States Patent
Cartier Millon et al.

(10) Patent No.: US 7,982,567 B2
(45) Date of Patent: Jul. 19, 2011

(54) ELECTROMAGNETIC ACTUATOR AND SWITCH APPARATUS EQUIPPED WITH SUCH AN ELECTROMAGNETIC ACTUATOR

(75) Inventors: Christophe Cartier Millon, Saint Martin d'Heres (FR); Christian Bataille, Voiron (FR); Philippe Pruvost, Grenoble (FR)

(73) Assignee: Schneider Electric Industries SAS, Rueil Maimaison (FR)

( * ) Notice: Subject to any disclaimer, the term of this patent is extended or adjusted under 35 U.S.C. 154(b) by 355 days.

(21) Appl. No.: 12/222,714

(22) Filed: Aug. 14, 2008

(65) Prior Publication Data

US 2009/0072934 A1 Mar. 19, 2009

(30) Foreign Application Priority Data

Sep. 17, 2007 (FR) ..... 07 06505

(51) Int. Cl.
*H01F 7/00* (2006.01)
*H01F 7/08* (2006.01)
*H01F 3/00* (2006.01)
*H01H 67/02* (2006.01)

(52) U.S. Cl. ..... 335/229; 335/131; 335/177; 335/179; 335/180; 335/185; 335/220; 335/230; 335/261; 335/279; 335/281; 335/296

(58) Field of Classification Search ..... 335/68, 335/71, 75, 87, 91, 92, 95, 121, 126, 127, 335/131, 147, 148, 177–179, 180–185, 220, 335/229, 230, 251, 255, 258, 261, 262, 265, 335/268, 279–282, 284, 296; 218/1, 7, 14, 218/48, 49, 57, 65, 78, 84, 92, 118, 120, 218/140, 154

See application file for complete search history.

(56) References Cited

U.S. PATENT DOCUMENTS

| | | | | |
|---|---|---|---|---|
| 4,644,311 | A * | 2/1987 | Guery et al. | 335/230 |
| 4,746,886 | A | 5/1988 | Uetsuhara | 335/230 |
| 5,239,277 | A * | 8/1993 | Vielot | 335/255 |
| 5,896,076 | A * | 4/1999 | van Namen | 335/229 |
| 6,020,567 | A * | 2/2000 | Ishikawa et al. | 218/154 |
| 6,373,675 | B1 | 4/2002 | Yamazaki et al. | 361/135 |
| 6,476,702 | B1 * | 11/2002 | Hartwig et al. | 335/220 |
| 7,425,687 | B2 * | 9/2008 | Morita et al. | 218/120 |
| 7,605,680 | B2 * | 10/2009 | Matsumoto et al. | 335/229 |
| 2002/0093408 | A1 * | 7/2002 | Morita et al. | 335/220 |
| 2005/0024174 | A1 * | 2/2005 | Kolb et al. | 335/220 |
| 2007/0171016 | A1 * | 7/2007 | Bonjean et al. | 335/234 |
| 2008/0136266 | A1 * | 6/2008 | Protze | 310/12 |

FOREIGN PATENT DOCUMENTS

| | | | |
|---|---|---|---|
| DE | 93 21 529 | U1 | 2/1999 |
| EP | 1655755 | A1 * | 5/2006 |
| JP | 58099256 | A * | 6/1983 |

* cited by examiner

*Primary Examiner* — Lincoln Donovan
*Assistant Examiner* — Mohamad A Musleh
(74) *Attorney, Agent, or Firm* — Steptoe & Johnson LLP

(57) ABSTRACT

An actuator comprising:

a fixed part comprising a ferromagnetic yoke and a magnetized assembly mounted on a face of the yoke and extending substantially over the whole dimension of said face parallel to the axis of movement of a moving part, the moving part comprising a ferromagnetic element comprising a first air-gap surface to form a magnetic air-gap of variable thickness and a second air-gap surface parallel to the axis of movement to form a residual magnetic air-gap of constant thickness with a corresponding air-gap surface of the magnetized assembly.

an excitation coil.

An electric switch apparatus equipped with the actuator.

8 Claims, 6 Drawing Sheets

ELECTROMAGNETIC ACTUATOR AND SWITCH APPARATUS EQUIPPED WITH SUCH AN ELECTROMAGNETIC ACTUATOR

BACKGROUND OF THE INVENTION

The invention relates to an electromagnetic actuator designed to be used in an electric switch apparatus, and in particular in an apparatus of relay, contactor or automatic tripping contactor type.

In particular, the invention concerns an electromagnetic actuator for a switch apparatus comprising a fixed part, a moving part and an excitation coil, the fixed part comprising a ferromagnetic yoke and a magnetized assembly composed of at least one magnet fixedly mounted on the yoke, the magnetized assembly extending in a direction substantially parallel to an axis of movement of the moving part, the moving part comprising a ferromagnetic element comprising a first air-gap surface to form a magnetic air-gap of variable thickness with the ferromagnetic yoke and a second air-gap surface to form a residual magnetic air-gap of substantially constant thickness with the fixed part, said second air-gap surface being substantially parallel to the axis of movement of the moving part, the excitation coil enabling the position and speed of the moving part to be controlled by means of an electric control current.

The invention also relates to an electric switch apparatus comprising at least one stationary contact operating in conjunction with at least one movable contact to switch the power supply of an electric load.

STATE OF THE ART

European Patent application EP1655755 describes such an electromagnetic actuator for an electric switch apparatus.

In this type of actuator, the force exerted on the moving part is mainly a Laplace force which results from the variation of the mutual inductance between the magnetized assembly and the excitation coil. This Laplace force is generally proportional to the current intensity in the excitation coil and to the induction generated by the magnetized assembly. The force exerted on the moving part is moreover also a magnetic force causing a change of the reluctance due to the variation of thickness of the air-gap of variable thickness between the open and closed positions.

One drawback of this type of actuator is that the force exerted on the moving part is not optimized which leads to the operating efficiency being reduced.

SUMMARY OF THE INVENTION

The object of the invention is to remedy the technical problems of devices of the prior art by proposing an electromagnetic for a switch apparatus comprising a fixed part, a moving part and an excitation coil, the fixed part comprising a ferromagnetic yoke and a magnetized assembly composed of at least one magnet fixedly mounted on the yoke, the magnetized assembly extending in a direction substantially parallel to an axis of movement of the moving part, the moving part comprising a ferromagnetic element comprising a first air-gap surface to form a magnetic air-gap of variable thickness with the ferromagnetic yoke and a second air-gap surface to form a residual magnetic air-gap of substantially constant thickness with the fixed part, said second air-gap surface being substantially parallel to the axis of movement of the moving part, the excitation coil enabling the position and speed of the moving part to be controlled by means of an electric control current.

The actuator according to the invention is characterized in that the magnetized assembly is mounted facing the second air-gap surface so that, whatever the position of the moving part, the residual magnetic air-gap is always formed between the second air-gap surface of the ferromagnetic element of the moving part and a corresponding air-gap surface of the magnetized assembly, and that the at least one magnet of the magnetized assembly is mounted on a face of the ferromagnetic yoke and extends substantially over the whole dimension parallel to the axis of movement of said face.

The ferromagnetic yoke preferably comprises a base, at least one lateral flank and a fixed central core, the at least one magnet of the magnetized assembly being mounted on one face of said flanks and extending over substantially the whole dimension parallel to the axis of movement of said flanks.

According to one embodiment, the excitation coil is fixedly mounted on the fixed part. Alternatively, the excitation coil is fixedly mounted on the moving part.

The excitation coil is preferably mounted in such a way as to surround the air-gap of variable thickness.

The ferromagnetic element of the moving part preferably comprises a central moving core, the first air-gap surface being formed on said core.

Advantageously, the ferromagnetic element of the moving part comprises at least one lateral part, the second air-gap surface being formed on said lateral part.

Preferably, the first air-gap surface and the corresponding air-gap surface of the ferromagnetic yoke forming the magnetic air-gap of variable thickness present two secant planes.

Advantageously, the actuator comprises a single magnetic air-gap of variable thickness.

The invention also concerns an electric switch apparatus comprising at least one stationary contact operating in conjunction with at least one movable contact to switch the power supply of an electric load, said apparatus comprising at least one electromagnetic actuator according to one of the foregoing claims to actuate the at least one movable contact.

BRIEF DESCRIPTION OF THE DRAWINGS

Other advantages and features will become more clearly apparent from the following description of particular embodiments of the invention, given for non-restrictive example purposes only, and represented in the accompanying figures.

DETAILED DESCRIPTION OF AN EMBODIMENT

Figure 1:
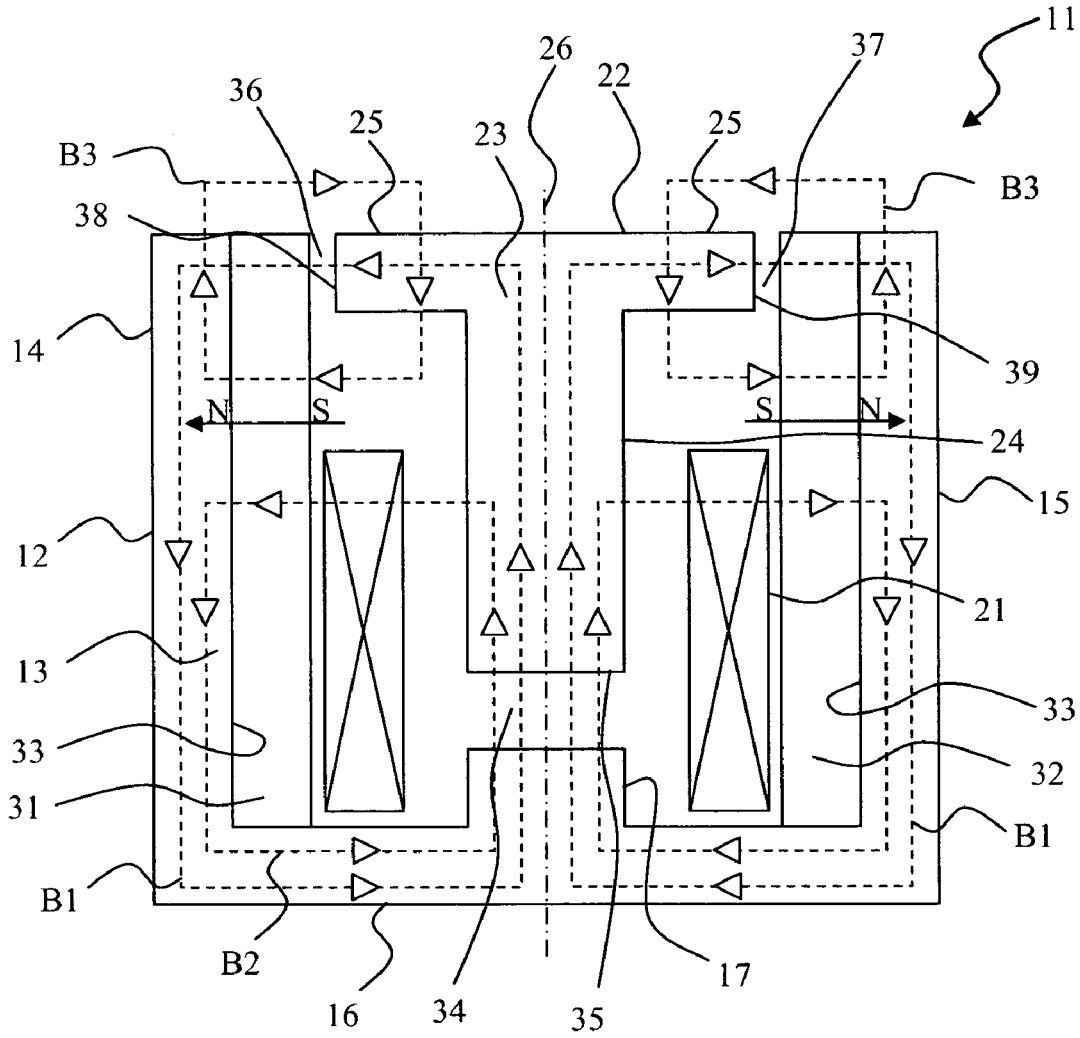
FIG. 1 represents a simplified longitudinal cross-section of a first embodiment of an actuator according to the invention in the open position.
Figure 2:
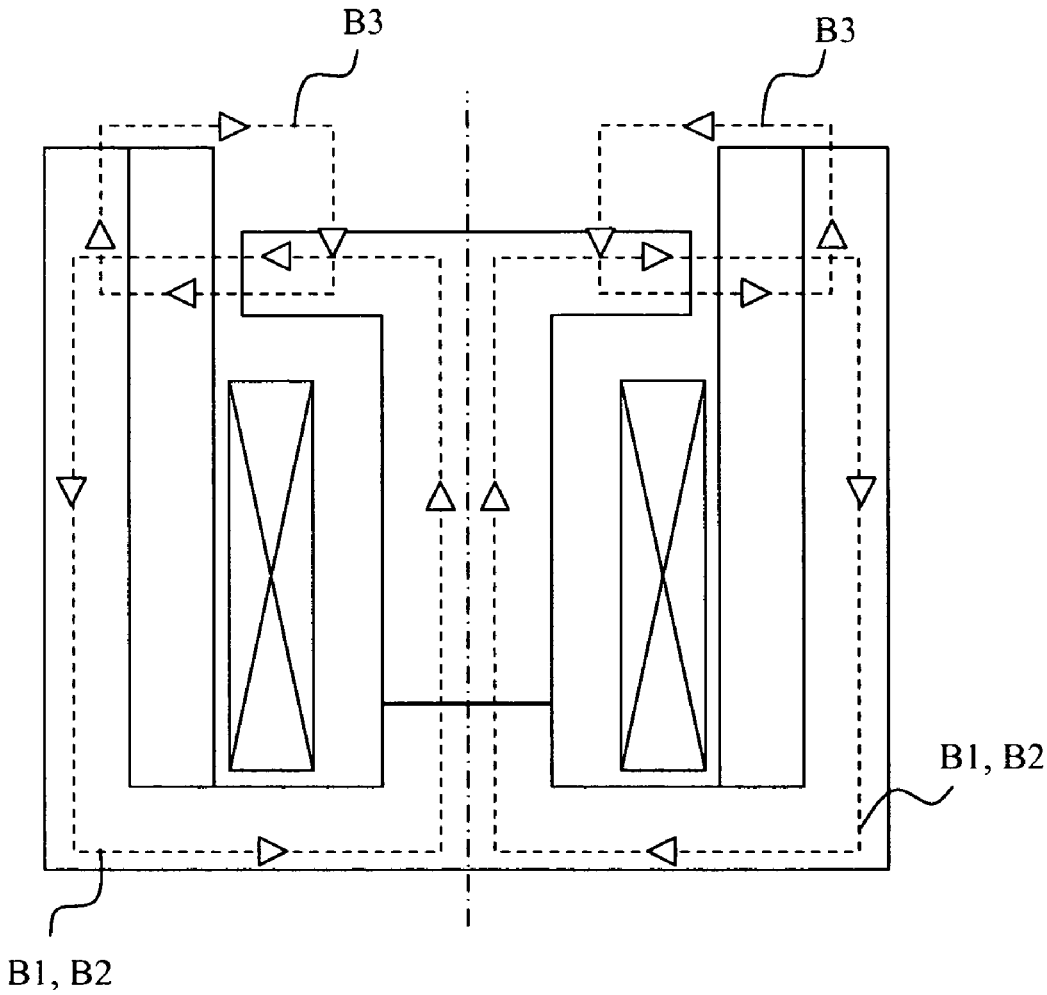
FIG. 2 represents the actuator of FIG. 1 in the closed position.

With reference to the first embodiment represented in FIGS. 1 and 2, an actuator 11 of an electric switch apparatus comprises a fixed part 12 comprising a ferromagnetic yoke 13 presenting a U-shape with two side lateral flanks 14, 15, a base 16 and a fixed central core 17.

In the embodiment of FIGS. 1 and 2, an excitation coil 21 is fixedly mounted on the fixed part 12 so as to surround fixed central core 17. This coil is associated with means, not shown, for regulating an electric control current to control the position and speed of the moving part. Moving part 22 is essentially formed by a ferromagnetic element 23 comprising a moving central core 24 and two lateral parts 25. This moving part can move along a longitudinal axis of movement 26 between a closed position, as represented in FIG. 2, and an open position, as represented in FIG. 1.

Actuator 11 also comprises a magnetized assembly composed of two magnets 31, 32 enabling moving part 22 to be moved when an current control electric flows through excitation coil 21. The magnets are fixed to a face 33 of the inside wall of lateral flanks 14, 15 and extend in a direction parallel to axis of movement 26. Magnets are mounted symmetrically with respect to axis of movement 26. The magnetization axes of magnets 31, 32 are perpendicular and symmetrical with respect to axis of movement 26, and they can be directed either towards this axis of movement or opposite to this same axis.

The magnetic circuit of actuator 11 comprises a magnetic air-gap of variable thickness 34 formed between a first air-gap surface 35 of ferromagnetic element 23 of moving part 22 and an associated air-gap surface of ferromagnetic yoke 13 of fixed part 12, the two surfaces being facing one another. As represented in FIGS. 1 and 2, the magnetic circuit of the actuator is made up of two halves which are symmetrical with respect to axis of movement 26. Each half of magnetic circuit comprises a residual magnetic air-gap 36, 37 of substantially constant thickness. This residual air-gap is formed between a second air-gap surface 38, 39 substantially parallel to axis of movement 26 and a corresponding air-gap surface of the fixed part. This residual air-gap in particular enables the magnetic circuit not to be saturated when the moving part is in a closed position.

As represented in FIGS. 1 and 2, according to one feature of the invention, magnets 31, 32 of the magnetized assembly are mounted facing second air-gap surface 38, 39. In this way, whatever the position of the moving part, residual magnetic air-gap 36, 37 is always formed between the second air-gap surface of ferromagnetic element 38, 39 and a corresponding air-gap surface on the magnetized assembly.

When a current is flowing in coil 21, the two symmetric halves of the magnetic circuit generate a magnetic flux B1. As represented in FIGS. 1 and 2, the path of magnetic flux B1 is as follows: fixed central core 17, base 16, flanks 14, 15, top part of magnets 31, 32, residual air-gaps 36, 37 between said magnets and second air-gap surface 38, 39 of the moving part, lateral parts 25 of moving part 22, moving central core 24, and air-gap of variable thickness 34. This magnetic flux B1 generates a magnetic force that is exerted on moving part 22 so as to reduce the thickness of air-gap of variable thickness 34.

In parallel, each magnet 31, 32 creates magnetic fluxes B2, B3 as represented in FIGS. 1 and 2. The path of magnetic flux B2 is as follows: moving central core 24, air-gap of variable thickness 34, fixed central core 17, base 16, flanks 14, 15, before looping back in magnets 31, 32. The path of magnetic flux B3 is for its part as follows: lateral parts 25 of moving part 22 and flanks 14, 15, before looping back in magnets 31, 32. Due to the magnetization axis of magnets 31, 32, fluxes B2 and B3 pass through the coil in substantially perpendicular manner to axis of movement 26. Thus, when a control current passes through coil 21, a Laplace force is created which also tends to make the moving part move along axis of movement 26. This force is proportional in particular to the current intensity in the coil and to the magnetic induction generated by the magnetized assembly.

As represented in FIG. 1, when actuator 11 is in the open position, the thickness of air-gap of variable thickness 34 is maximum and the force of attraction created by magnetic flux B1 on the moving part is minimum due to the fact that this force is generally inversely proportional to the thickness of the air-gap of the magnetic circuit. When a current flows in coil 21, the magnetic force generated by the coil and the Laplace force will both contribute to moving part 22 to the closed position. The combination of these two magnetic forces is all the greater as magnetic fluxes B1, B2 generated on the one hand by the magnet and on the other hand by the excitation coil are both directed in the same direction in the whole of moving part 22, and in the air-gap of variable thickness. This leads to an increase of the operating efficiency of the actuator.

When actuator 11 is in the closed position, the thickness of air-gap of variable thickness 34 is minimum, and the force of attraction created by magnetic flux B1 on the moving part is maximum. To perform the opening movement, actuator 11 can comprise return means such as a return spring, not shown. This movement can in addition be controlled by means of the control current in coil 21. For example to speed up opening in particular, i.e. movement of the moving part to an open position, a reverse current can be sent to coil 21 so as to counteract the Laplace force.

As represented in FIGS. 1 and 2, magnets 31 and 32 of the magnetized assembly are mounted on a face 33 of the inside wall of lateral flanks 14, 15. Each magnet extends substantially over the whole dimension parallel to the axis of movement of said face, i.e. over the whole height of the inside wall of the lateral flanks. This enables it to be ensured that magnetic fluxes B1, B2 generated on the one hand by the magnet and on the other hand by the excitation coil are both directed in the same direction over a larger part of moving part 22, or even over the whole of moving part 22, and also in the air-gap of variable thickness. In this way, the intensity of the magnetic forces resulting from these two fluxes and the operating efficiency of the actuator are increased.

Furthermore, coil 21 being mounted on fixed part 12, the weight of the moving part is relatively low in comparison with an actuator of "voice coil" type, i.e. with an excitation coil mounted on the moving part. This leads to the global efficiency of the actuator being improved.

Figure 3:
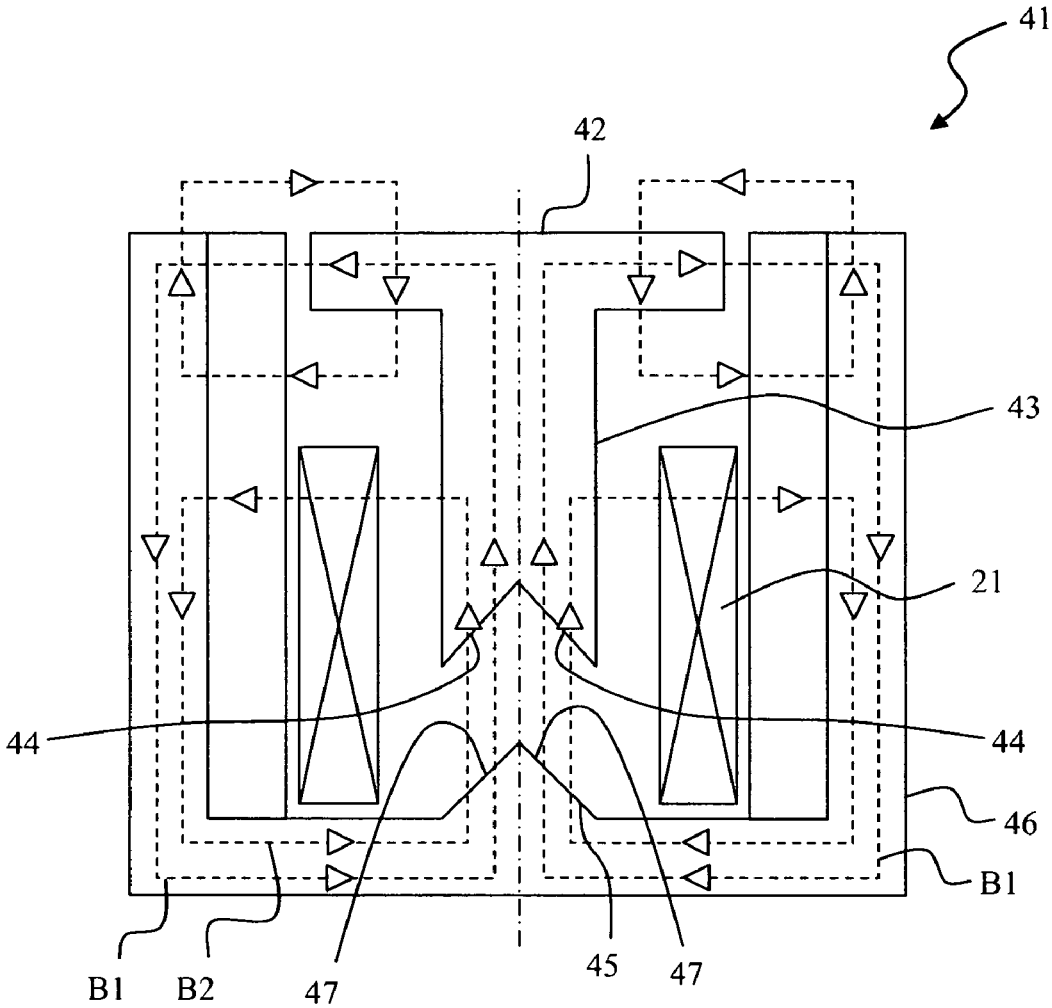
FIG. 3 schematically represents an alternative embodiment with respect to the embodiment of FIGS. 1 and 2.

In an alternative embodiment represented in FIG. 3, an actuator 41 comprises most of the elements represented in FIGS. 1 and 2. In this alternative embodiment, moving part 42 of the magnetic circuit is composed of a moving central core 43 made of ferromagnetic material comprising a first air-gap surface 44 which is not perpendicular to the axis of movement. In actuator 41, first air-gap surface 44 presents two secant planes. In the same way, fixed central core 45 of ferromagnetic yoke 46 presents a corresponding air-gap surface 47 complementary to the first air-gap surface. The shape of air-gap surfaces 44, 47 forming the air-gap of variable thickness of actuator 41 in particular enables the size of said air-gap surfaces to be increased. The magnetic force of attraction generated by flow of a control current in coil 21 is therefore greater.

In the alternative embodiment represented in FIG. 3, first air-gap surface 44 presents a groove-shape. Corresponding air-gap surface 47 of fixed central core 45 of ferromagnetic yoke 46 for its part presents the form of a protuberance or a bevel. With such a configuration, the moving central core recovers a larger part of the magnetic losses, due to its groove-shaped air-gap. These magnetic losses are therefore minimized, which leads to an increase of the closing force. This alternative embodiment is particularly advantageous in the embodiments requiring on the one hand an earlier appearance of the magnetic forces in the course of actuation, and on the other hand a better magnetic holding in the closed position.

Figure 4:
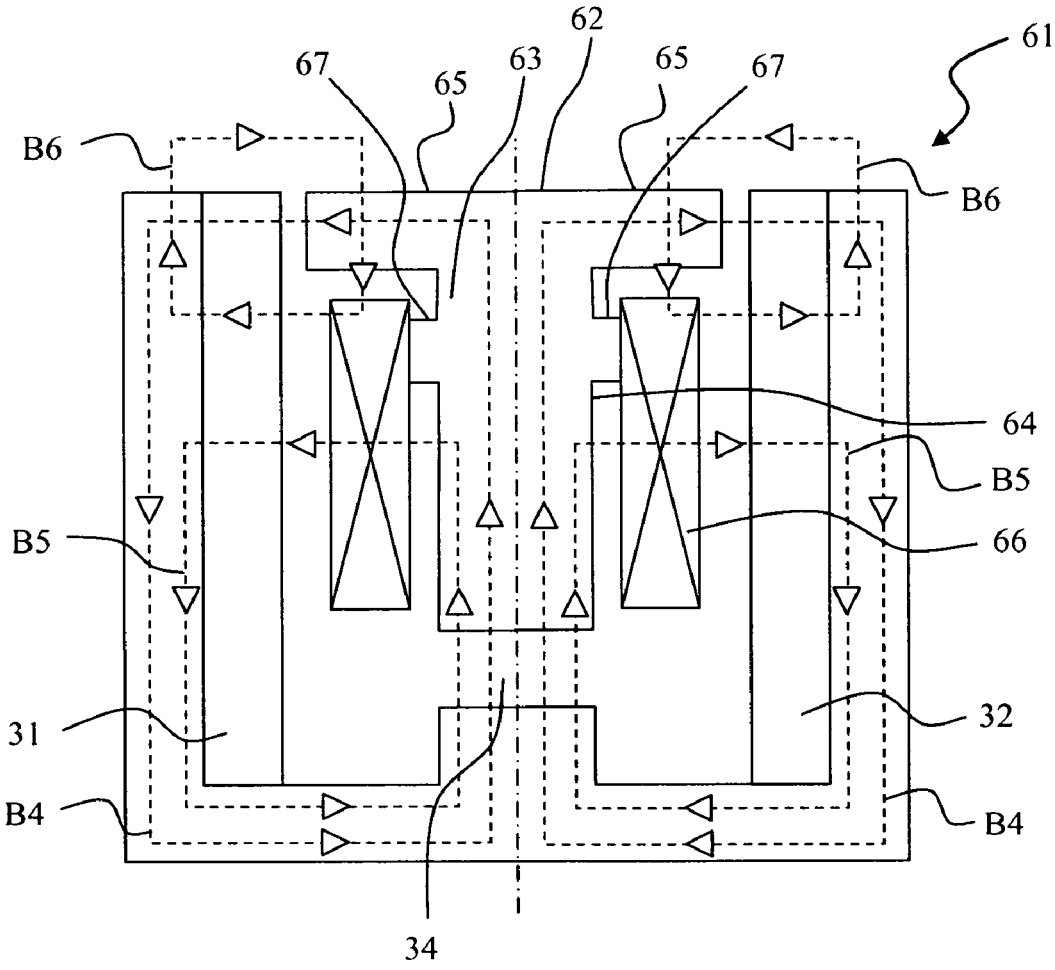
FIG. 4 represents a simplified longitudinal cross-section of a second embodiment of an actuator according to the invention in the open position.

In the embodiment represented in FIG. 4, the excitation coil is fixedly mounted on the moving part. Actuator 61 comprises a fixed part 12 comprising a ferromagnetic yoke 13 presenting a U-shape and a moving part 62 comprising a ferromagnetic element 63 comprising a moving central core 64 and two lateral parts 65. Excitation coil 66 is fixedly mounted on moving part 62 by means of connecting means 67 between the coil and moving central core 64 of moving part 62. The coil is also mounted in such a way as to surround moving central core 64 of moving part 62.

When a current flows in coil 66, the two symmetric halves of the magnetic circuit generate a flux B4 the path of which is substantially the same as in the embodiment of FIGS. 1 and 2. This magnetic flux generates a magnetic force exerted on moving part 62 so as to reduce the thickness of air-gap of variable thickness 34. In parallel, each magnet 31, 32 creates magnetic fluxes B5, B6 whose paths are substantially the same as in the embodiment of FIGS. 1 and 2. When a control current flows through coil 66, a Laplace force is created which also tends to make the moving part move. The magnetic force generated by the coil and the Laplace force will therefore both contribute to moving moving part 62 to a closed position. The combination of these two magnetic forces is all the greater as magnetic fluxes B4, B5 generated on the one hand by the magnet and on the other hand by the excitation coil are both directed in the same direction in a large part of moving part 62, or even in the whole of said moving part 62, as well as in the air-gap of variable thickness. This leads to the operating efficiency of the actuator being increased.

Figure 5:
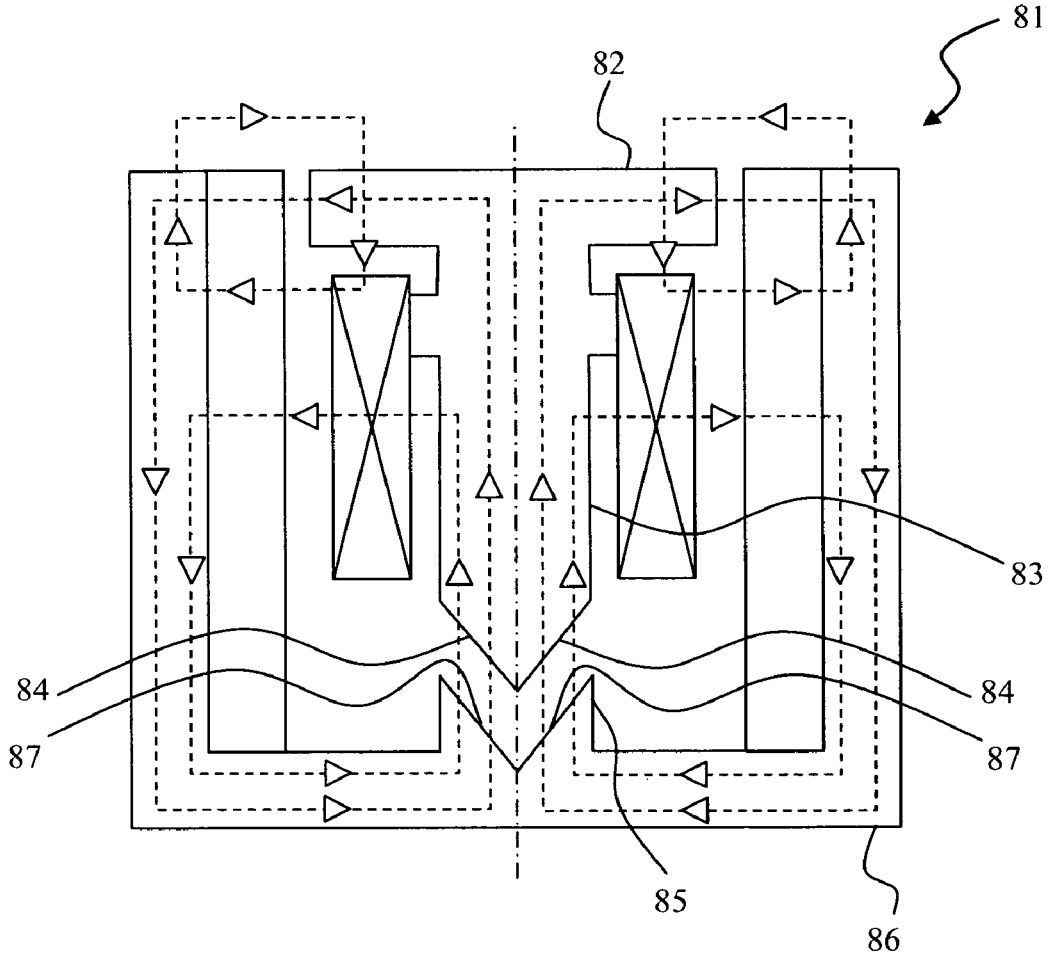
FIG. 5 schematically represents an alternative embodiment with respect to the embodiment of FIG. 4.

In an alternative embodiment represented in FIG. 5, an actuator 81 comprises most of the elements represented in FIG. 4. As in the embodiment of FIG. 4, a "voice-coil" type actuator is involved, i.e. an actuator in which the excitation coil is fixedly mounted on the moving part. In this alternative embodiment, moving part 82 of the magnetic circuit is composed of a moving central core 83 made of ferromagnetic material comprising a first air-gap surface 84. As in the alternative embodiment represented in FIG. 3, the first air-gap surface is not perpendicular to axis of movement 84. This first air-gap surface 84 presents two secant planes. In the same way, fixed central core 85 of ferromagnetic yoke 86 presents a corresponding air-gap surface 87 complementary to the first air-gap surface. The shape of air-gap surfaces 84, 87 in particular enables the size of said air-gap surfaces to be increased. The magnetic force of attraction generated by flow of a control current in coil 66 is therefore greater.

In the alternative embodiment represented in FIG. 5 and unlike that of FIG. 3, first air-gap surface 84 presents the form of a protuberance or bevel. Corresponding air-gap surface 87 of fixed central core 85 of ferromagnetic yoke 86 for its part presents a groove-shape. With such a configuration, there are less magnetic losses flowing through the moving central core than with the configuration represented in FIG. 3. The magnetic force of attraction is therefore less, which, depending on the specifications chosen, enables monostable operation of the device to be defined.

Figure 6:
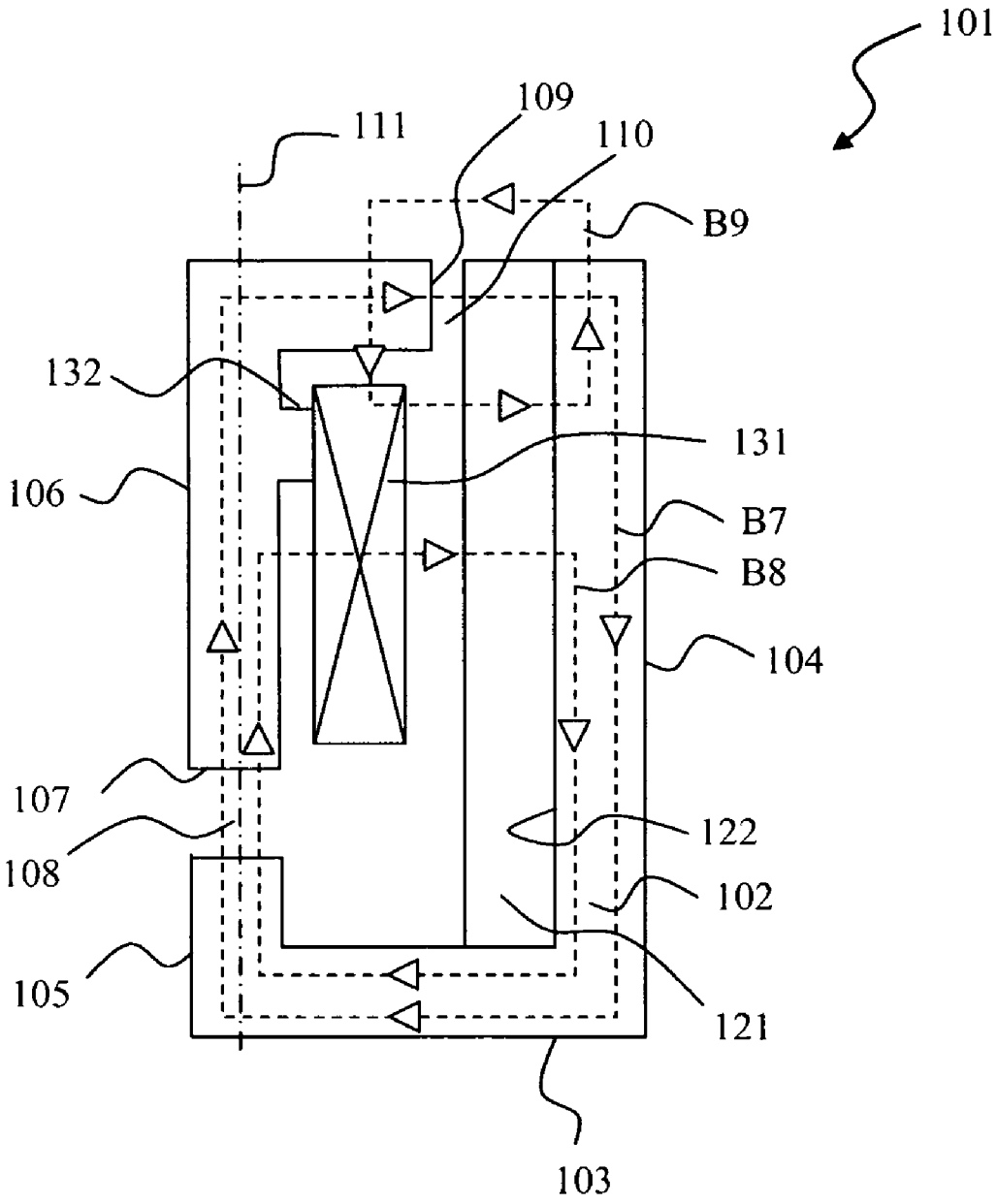
FIG. 6 represents a simplified longitudinal cross-section of a particular embodiment according to the invention.

In the embodiment represented in FIG. 6, electromagnetic actuator 101 only comprises one half of a magnetic circuit with respect to that represented in FIG. 4. The magnetic circuit comprises a fixed part comprising a J-shaped ferromagnetic yoke 102 comprising a base 103, a main flank 104 and a secondary flank 105. The magnetic circuit also comprises a moving part 106 comprising a ferromagnetic element comprising a first air-gap surface 107 to form a magnetic air-gap of variable thickness 108 with ferromagnetic yoke 102. The magnetic circuit further comprises a second air-gap surface 109 to form a residual magnetic air-gap 110 with the fixed part of substantially constant thickness. Second air-gap surface 109 is substantially parallel to an axis of movement 111 of the moving part. A magnetized assembly composed of a magnet 121 is fixedly mounted on a face 122 of the inside wall of main flank 104. The magnet extends in a direction substantially parallel to an axis of movement 111 of the moving part over the whole dimension parallel to the axis of movement of face 122 of the inside wall of main flank 104.

In the embodiment of FIG. 6, magnet 121 is mounted facing second air-gap surface 109 such that, whatever the position of moving part 106, residual magnetic air-gap 110 is always formed between second air-gap surface 109 of the ferromagnetic element of moving part 106 and a corresponding air-gap surface of magnet 121.

In the embodiment of FIG. 6, excitation coil 131 enabling the position and speed of the moving part to be controlled by means of an electric control current is fixedly mounted on moving part 106 by connecting means 132. In other embodiments, not shown, this excitation coil could also have been fixedly mounted on the fixed part.

When a current flows in coil 131, the magnetic circuit generates a flux B7 and the magnet generates fluxes B8, B9. The paths of these fluxes are similar to those represented in FIG. 4 over a half of a magnetic circuit with respect to axis of movement 111. These magnetic fluxes generate magnetic forces exerted on moving part 106 so as to reduce the thickness of air-gap of variable thickness 108. These magnetic forces will both contribute to moving part 106 to a closed position. The combination of these two magnetic forces is all the greater as magnetic fluxes B7, B8 generated on the one hand by the magnet and on the other hand by the excitation coil are both directed in the same direction in most of moving part 106, or even in the whole of moving part 106, and also in the air-gap of variable thickness. This leads to the operating efficiency of the actuator being increased.

The actuator according to the invention can be used in any switching apparatus for protection or control, such as contactors, circuit breakers, relays, or switches. The actuator according to the invention can also be an electromagnetic actuator of bistable or monostable type.

The invention claimed is:

1. An electromagnetic actuator for a switch apparatus, comprising a fixed part, a moving part and an excitation coil, the fixed part comprising a ferromagnetic yoke and a magnetized assembly of at least one magnet fixedly mounted on the yoke, the magnetized assembly extending in a direction substantially parallel to an axis of movement of the moving part, the moving part comprising a ferromagnetic element comprising a first air-gap surface for forming a magnetic air-gap of variable thickness from the ferromagnetic yoke, and a second air-gap surface for forming a residual magnetic air-gap of substantially constant thickness from the fixed part, said second air-gap surface being substantially parallel to the axis of movement of the moving part, the excitation coil enabling the position and speed of the moving part to be controlled by an electric control current, wherein the magnetized assembly faces the second air-gap surface so that, whatever the position of the moving part, the residual magnetic air-gap is always between the second air-gap surface of the ferromagnetic element of the moving part and a corresponding air-gap surface of the magnetized assembly, and the at least one magnet of the magnetized assembly is on a face of the ferromagnetic yoke and extends substantially over the entire dimension of said face parallel to the axis of movement.

2. The actuator according to claim 1, wherein the ferromagnetic yoke comprises a base, at least one lateral flank and a fixed central core, the at least one magnet of the magnetized assembly is mounted on a face of said flank and extends over substantially the entire dimension of said flank parallel to the axis of movement of the moving part.

3. The actuator according to claim 1, wherein the excitation coil is fixedly mounted on the fixed part.

4. The actuator according to claim 1, wherein the excitation coil is fixedly mounted on the moving part.

5. The actuator according to claim 1, wherein the excitation coil is mounted so as to surround the air-gap of variable thickness.

6. The actuator according to claim 1, wherein the ferromagnetic element of the moving part comprises a moving central core, and the first air-gap surface is on said core.

7. The actuator according to claim 1, wherein the ferromagnetic element of the moving part comprises at least one lateral part, and the second air-gap surface is on said lateral part.

8. The actuator according to claim 1, wherein the first air-gap surface and the corresponding air-gap surface of the ferromagnetic yoke forming the magnetic air-gap of variable thickness present two secant planes.

* * * * *